US009109768B2

(12) United States Patent
Han et al.

(10) Patent No.: US 9,109,768 B2
(45) Date of Patent: Aug. 18, 2015

(54) ILLUMINATION SYSTEM

(71) Applicants: Hou Hua Han, Guangshui (CN); Bing Zhang, Guangshui (CN)

(72) Inventors: Hou Hua Han, Guangshui (CN); Bing Zhang, Guangshui (CN)

(73) Assignee: UCP International Co. Ltd., Hong Kong (HK)

( * ) Notice: Subject to any disclaimer, the term of this patent is extended or adjusted under 35 U.S.C. 154(b) by 0 days.

(21) Appl. No.: 13/926,339

(22) Filed: Jun. 25, 2013

(65) Prior Publication Data

US 2014/0218925 A1 Aug. 7, 2014

(51) Int. Cl.

| | |
|---|---|
| ***F21V 21/00*** | (2006.01) |
| ***F21S 4/00*** | (2006.01) |
| *F21W 121/04* | (2006.01) |
| *F21V 19/00* | (2006.01) |

(52) U.S. Cl.

CPC ..... *F21S 4/001* (2013.01); *F21V 19/0005* (2013.01); *F21V 19/0035* (2013.01); *F21W 2121/04* (2013.01)

(58) Field of Classification Search

CPC ..... F21W 2121/04; H01R 13/7032; H01R 13/7033; F21V 21/0885; F21V 19/0005; F21V 21/088; F21V 19/0025; F21V 19/0035; F21V 19/0045; F21S 4/001; F21S 4/002; F21S 4/005; F21S 4/007

USPC ..... 362/391, 640, 654, 653, 652, 657, 647, 362/249.14, 806, 248.15, 249.16, 249.17, 362/249.18, 249.19; 439/188, 513

See application file for complete search history.

(56) References Cited

U.S. PATENT DOCUMENTS

| | | | | |
|---|---|---|---|---|
| 5,277,607 | A * | 1/1994 | Thumma et al. | 439/188 |
| 6,053,620 | A * | 4/2000 | Won | 362/96 |
| 6,059,425 | A * | 5/2000 | Wang | 362/249.01 |
| 6,257,740 | B1 * | 7/2001 | Gibboney, Jr. | 362/288 |
| 7,153,019 | B2 * | 12/2006 | Kuo | 362/657 |
| 7,186,017 | B2 * | 3/2007 | Kuo | 362/654 |
| 7,484,995 | B2 * | 2/2009 | Ding | 439/513 |
| 7,771,109 | B2 * | 8/2010 | Huang et al. | 362/654 |
| 2006/0146578 | A1 * | 7/2006 | Kuo | 362/654 |
| 2006/0274556 | A1 * | 12/2006 | Massabki et al. | 362/652 |
| 2008/0198629 | A1 * | 8/2008 | Lee | 362/654 |
| 2008/0299817 | A1 * | 12/2008 | Liu | 439/419 |
| 2009/0073685 | A1 * | 3/2009 | Pan | 362/227 |
| 2011/0136361 | A1 * | 6/2011 | Cheng et al. | 439/188 |
| 2011/0269353 | A1 * | 11/2011 | Li et al. | 439/699.2 |
| 2012/0025694 | A1 * | 2/2012 | Bing | 313/318.01 |

* cited by examiner

*Primary Examiner* — Jong-Suk (James) Lee
*Assistant Examiner* — James Endo
(74) *Attorney, Agent, or Firm* — YANG IPCo, PLLC

(57) ABSTRACT

An illumination system operable for use as a string of Christmas lights may include a plurality of lamps connected in series. Each lamp may include a lamp luminary, a lamp stem, a lamp holder, and a pair of cables connected to the lamp holder. The lamp stem may have an insertion portion. The lamp holder may have an accommodation space formed therein. When the lamp stem is disposed in the accommodation space, the insertion portion may be clamped between a pair of first protrusions to separate the protrusions. When the lamp stem is removed from the accommodation space, the pair of first protrusions may resume contact through the elastic nature of the cable and the protrusions. The illumination system may be simple in structure and may be convenient for use.

11 Claims, 4 Drawing Sheets

ILLUMINATION SYSTEM

CROSS-REFERENCE TO RELATED APPLICATION

This application claims priority under 35 U.S.C. 119(a) to Chinese application no. 201320068948.8, filed on Feb. 4, 2013, in the Chinese Patent Office, which is incorporated by reference in its entirety as if set forth in full.

TECHNICAL FIELD

The disclosure relates to an illumination lamp, and more particularly, to an illumination lamp system suitable for use as a Christmas lighting.

BACKGROUND

An illumination system may achieve simultaneous working of a plurality of lamps mainly through a series connection of the lamps. However, when one of the lamps fails to work properly due to a fault, or when the lamp stems is removed from the lamp holder of the illumination lamp, such a series connection structure may exhibit abnormal working. The result requires the disconnection of the entire series lamp string connected to the defective lamp. Therefore, such a series connection structure is inconvenient to use. Current electronic shunt devices may overcome the above problems regarding the power supplied to the lamps by connecting each of the lamps in parallel. Thus, when one of the lamps fails, other lamps may still function properly. However, such a structure likely consumes a large amount of electrical energy and may be costly to operate. Other illumination lamps may connect lamps in series to achieve contact between the terminals by enabling the terminals to contact each other through means of external drive after the lamp stem is removed. Such structures are relatively complicated and inconvenient to carry out.

SUMMARY

The present disclosure may advantageously provide for an illumination system, operable for use as a Christmas lighting, with low electric energy consumption, low cost, simple structure, and convenience of operation. The present disclosure may advantageously address many of the problems in embodiments with high power consumption, high cost, complicated structures comprising series of lamp strings, and embodiments that are difficult to operate. The present disclosure may advantageously allow for an illumination system wherein after one lamp fails and the lamp stem thereof is removed, other lamps may still function properly.

The present disclosure may address the aforementioned technical problems by providing an illumination system that may comprise a plurality of lamps connected in series, wherein each of the lamps may comprise a lamp luminary, a lamp stem may retain the lamp luminary, a lamp holder, and a pair of cables that may be connected to the lamp holder, wherein the lamp stem may have an insertion portion, wherein the lamp holder may have an accommodation space formed therein, wherein each of end portions of the pair of cables may be provided respectively with a conductive terminal which may be electrically connected with the cable and internally accommodated in the accommodation space, wherein each of the terminals may be provided with a conductive first protrusion thereon, and wherein a pair of the first protrusions may be disposed oppositely and the pair of the first protrusions may contact one another or separate from each other. When the lamp stem is accommodated in the accommodation space, the insertion portion may be clamped between the pair of the first protrusions to separate the pair of the first protrusions. When the lamp stem is removed from the accommodation space, the pair of the first protrusions may elastically resume contacting one another.

The accommodation space may be provided with a tubular first accommodation space in an upper portion, and a second accommodation space in lower portion which may be enclosed with two opposing planar walls extending upwardly from the bottom and arc-shaped walls connected with the planar walls, and the shape of the accommodation space may be adapted to the outer profile of the lamp stem.

Each of the upper ends of the terminals may be provided with a lamp pin contacting portion, and the accommodation space may be internally provided with seizing portions to seize the lamp pin contacting portions.

Each of the upper portions of the terminals may be provided with a first fixing portion, a copper wire protrudes from each of top ends of the cables, and the copper wires may be fixed on the first fixing portions to achieve electrical connection between the terminals and the cables.

Each of the lower ends of the terminals may be provided with a tubular second fixing portion, and each of the cables may go through and may be disposed within the second fixing portion. Each of lower ends of the second fixing portions may be further provided with a U-shaped notch which enables swinging of the cables along radial direction of the second fixing portion. The U-shaped notches may face toward the arc-shaped walls.

At least one second protrusion may be further provided on each of outer sides of the terminals, the second protrusions may lean against the arc-shaped walls.

Each of the second protrusions may be an elastic member with an arc-shaped surface.

The terminals may be obliquely disposed within the accommodation space, and the two terminals may exhibit a V-shaped structure.

The lamp holder may be provided with a first tightening portion on bottom end to make the pair of the cables go through the tightening portion and to tighten the pair of the cables. The first tightening portion may have at least one arc-shaped step protruding inwardly along bottom face of the lamp holder.

The lamp holder may be further provided with a second tightening portion on the lower portion to tighten the pair of the cables; and the second tightening portion may have a through hole, and the pair of cables may be connected with the lamp holder by going through the through hole.

The implementation of the illumination system of the present disclosure, operable for use as a Christmas lighting, may have the following beneficial effects: by oppositely disposing the conductive first protrusions on a pair of terminals, clamping, at the same time, the lower end of the lamp stem between a pair of the first protrusions; making the pair of the first protrusions contact one another upon the remove of the lamp stem due to the obliquely disposing of the terminals; and meanwhile disposing a second protrusion which may be an elastic member on each of outer side of the terminals, wherein when the lamp stem is inserted in, the elastic member may be in a pressed state; and when the lamp stem is removed, the resilience of the elastic member and the tension of the cables may enable the pair of the first protrusions to contact more easily so as to maintain the whole current circuit in an on-state. The illumination system of the present disclosure may be convenient to use and easy to manufacture, and may have stable properties and low cost.

BRIEF DESCRIPTION OF THE DRAWINGS

Further illustration will be made in conjunction with the following Figures and Examples, in which.

DETAILED DESCRIPTION

Figure 1:
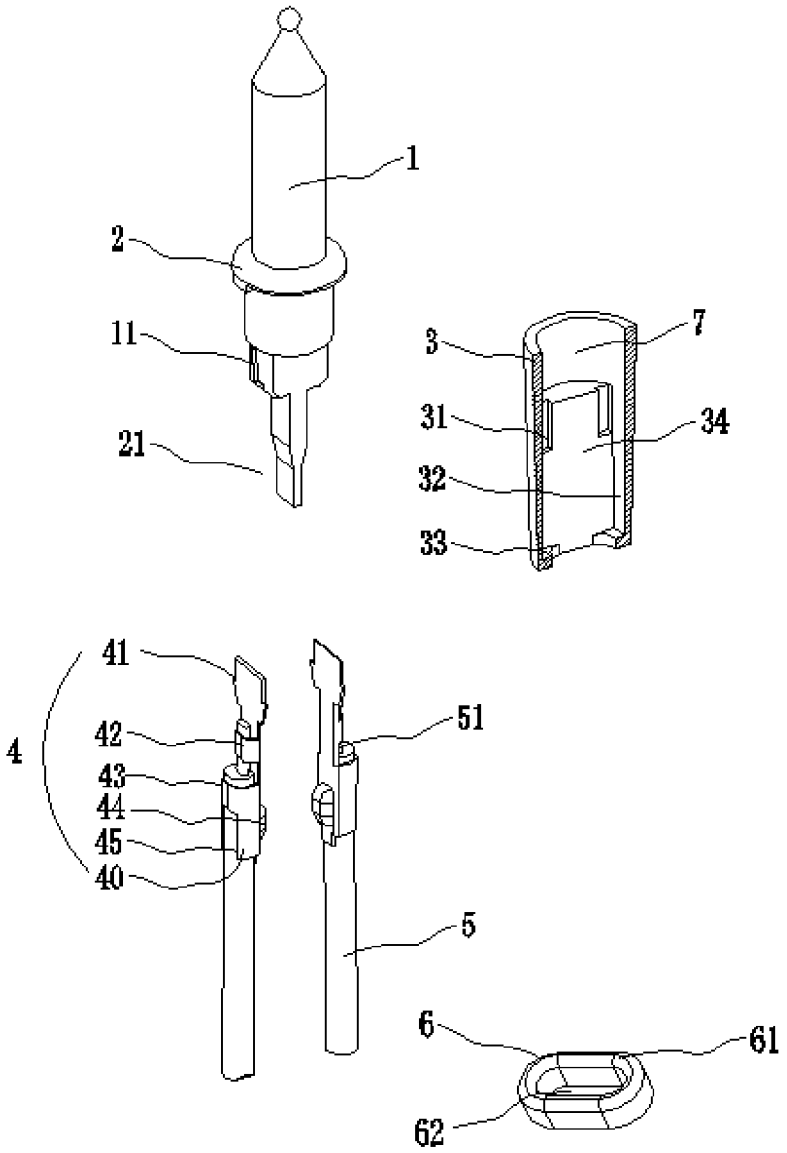
FIG. 1 depicts an exploded schematic drawing of a lamp of the illumination system according to an embodiment of the present disclosure, in which the lamp holder is in a cutaway view.
Figure 2:
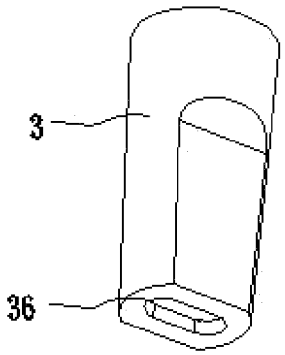
FIG. 2 depicts a whole structural schematic drawing of the lamp holder of the illumination system according to an embodiment of the present disclosure.
Figure 3:
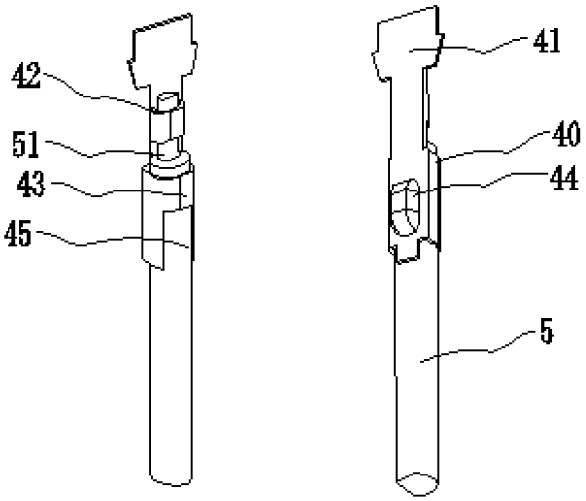
FIG. 3 depicts a structural schematic drawing of the cables and terminals of illumination system according to an embodiment of the present disclosure.

As shown in FIGS. 1, 2 and 3, the present disclosure provides an illumination system which may comprise a plurality of lamps connected in series, each of the lamps comprising a lamp luminary 1, a lamp stem 2 retaining the lamp luminary 1, a lamp holder 3 and a pair of cables 5 connected to the lamp holder 3. The lamp stem 2 may have an insertion portion 21, the lamp holder 3 may have an accommodation space 7 formed therein, each of end portions of the pair of cables 5 may be provided respectively with a conductive terminal 4 which may be electrically connected with the cable 5 and internally accommodated in the accommodation space 7, each of the terminals 4 may be provided with a conductive first protrusion 44 thereon, a pair of the first protrusions 44 may be disposed oppositely and the pair of the first protrusions 44 contact one another or separate from each other. When the lamp stem 2 is accommodated in the accommodation space 7, the insertion portion 21 may be clamped between the pair of the first protrusions 44 to separate the pair of the first protrusions 44. When the lamp stem 2 is removed from the accommodation space 7, the pair of the first protrusions 44 may elastically resume contacting one another.

Figure 4:
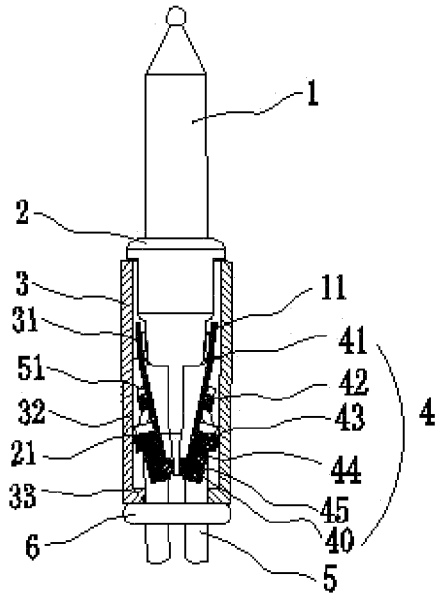
FIG. 4 depicts a cutaway view of the lamp stem being inserted into the lamp holder of the illumination system according to an embodiment of the present disclosure.
Figure 5:
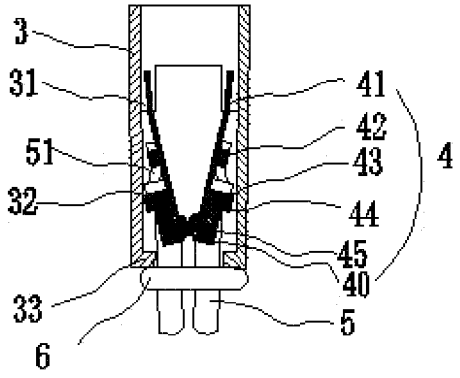
FIG. 5 depicts a cutaway view of the lamp stem being removed from the lamp holder of the illumination system according to an embodiment of the present disclosure.
Figure 6:
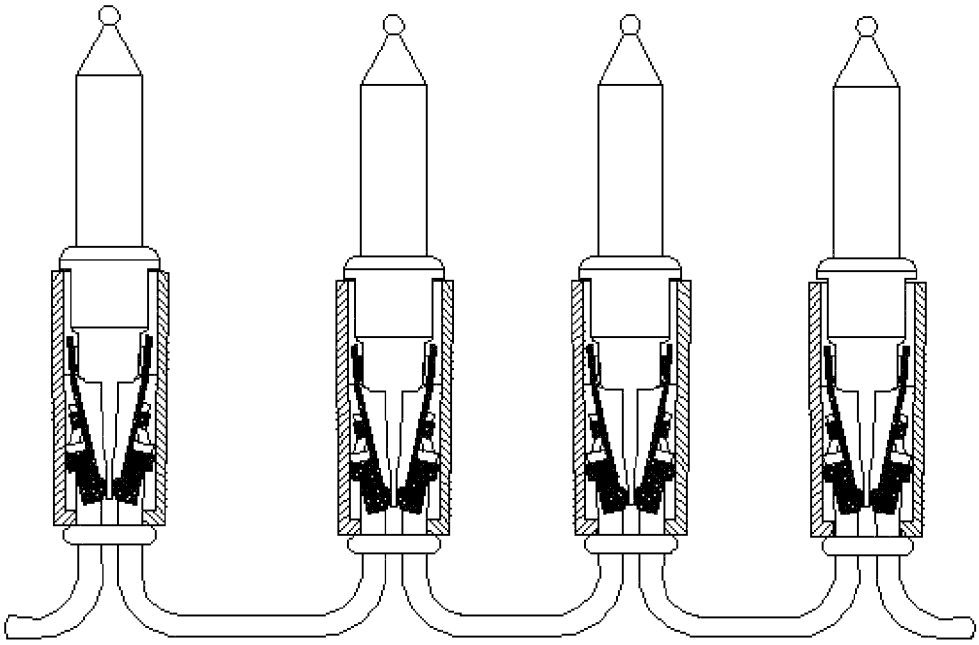
FIG. 6 depicts a structural schematic drawing of a plurality of the serially connected lamps of the illumination system according to an embodiment of the present disclosure.
Figure 7:
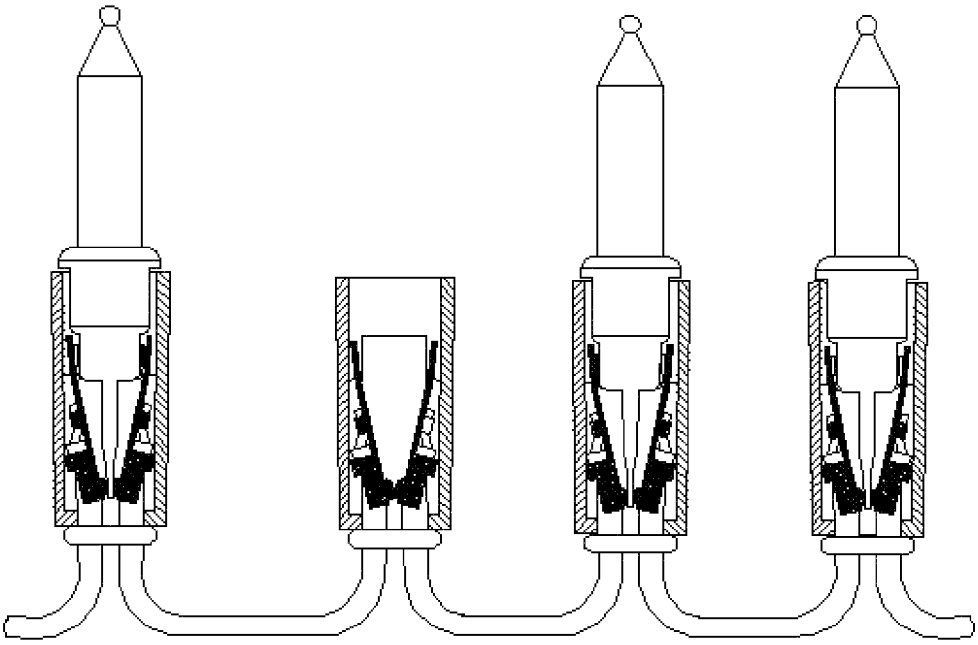
FIG. 7 depicts a structural schematic drawing of pulling out a lamp luminary and a lamp stem from a plurality of the serially connected lamps of the illumination system according to an embodiment of the present disclosure.

Specifically, contact copper wires 11 for connecting with the lamp luminary 1 are provided on either side of the lamp stem 2, the insertion portion 21 may be made of insulating material. When the lamp stem 2 is inserted into the inner portion of lamp holder 3, the insertion portion 21 may be clamped between a pair of the first protrusions 44, as shown in FIGS. 4 and 6. In this configuration, the contact copper wires 11 may be in contact with the terminals 4, through the cables 5 and terminals 4, the lamp luminary 1 may be powered on and in a working state. When the lamp stem 2 is removed together with the lamp luminary 1, as shown in FIGS. 5 and 7, the contact copper wires 11 may be detached from contacting with the terminals 4, and at this time, the two first protrusions 44 may resume the state of contacting one another, which may make the current circuit a complete one after the lamp stem 2 is removed, and the working of other lamps connected in series with this lamp may not be influenced.

As shown in FIG. 1, the accommodation space 7 may be provided with a tubular first accommodation space in upper portion, and a second accommodation space in lower portion which may be enclosed with two opposing planar walls 34 extending upwardly from the bottom and arc-shaped walls 32 connected with the planar walls 34, and shape of the accommodation space 7 may be adapted to outer profile of the lamp stem 2.

One of ordinary skill in the art would understood that, one may prevent lamp stem 2 from swinging by making the shape of the accommodation space 7 adapted to the outer profile of the lamp stem 2. Meanwhile, the width of the space formed between the two planar walls 34 may also be adapted to the width of the portions of the terminals 4 disposed in the space, which may prevent the portions of terminals 4 from swinging within the space.

Each of upper portions of the terminals 4 may be provided with a first fixing portion 42, a copper wire 51 may protrude from each of top ends of the cables 5, and the copper wires 51 may be fixed on the first fixing portions 42 to achieve electrical connection between the terminals 4 and the cables 5.

Specifically, the way of the first fixing portions 42 fixing the copper wires 51 may be folding the conductor portions extending from the upper of terminals 4, encircling the same with the copper wires 51 and pressing the copper wires 51 tightly. The copper wires 51 protruded and disposed on the top ends of the wires 5 may be exposed by removing the insulating layer of the top ends of cables 5. At the same time, one of ordinary skill in the art would understood that, the way of tightening the copper wires 51 tightly on the terminals 4 may also be achieved by adhesion with conductive adhesive or by other ways.

Each of lower ends of the terminals 4 may be provided with a tubular second fixing portion 40, and each of the cables 5 goes through and may be disposed within the second fixing portion 40. Each of lower ends of the second fixing portions 40 may be further provided with a U-shaped notch 45 which enables swinging of the cables 5 along radial direction of the second fixing portion 40. The U-shaped notches 45 may face toward the arc-shaped walls 32.

One of the purposes of disposing the second fixing portions may be to further achieve the tightening of the terminals 4 and the cables 5, so as to prevent the copper wires 51 from detaching from the first fixing portions 42 under the action of external force.

Preferably, the first protrusions 44 may be disposed on the inner side of the lower ends of the second fixing portions 40.

Each of upper ends of the terminals 4 may be provided with a lamp pin contacting portion 41, and the accommodation space 7 may be internally provided with seizing portions 31 to seize the lamp pin contacting portions 41. The seizing portions 31 may be provided on either side of the upper ends of the planar walls 34, and may be grooved notches extending for a certain height from top to bottom.

At least one second protrusion 43 may be further provided on each of outer sides of the terminals 4, the second protrusions 43 may lean against the arc-shaped walls 32. Each of the second protrusions 43 may have an arc-shaped surface. Preferably, each of the second protrusions 43 may have an elastic member with an arc-shaped surface, by disposing the second protrusions 43 on the outer sides of the terminals 4, the two second protrusions 43 may contact with the arc-shaped walls 32 and the second protrusions 43 may be pressed when the lamp stem 2 is inserted, and when the lamp stem 2 is removed, the second protrusions 43 may rebound and make the terminals 4 easier to resume the positions where the two first protrusions 44 contact one another.

One of ordinary skill in the art would understood that, each of the second protrusions 43 may be made of elastic material, such as can be made of silicone, PU glue or the like.

The terminals 4 may be obliquely disposed within the accommodation space 7, and the two terminals 4 may exhibit a V-shaped structure.

Since the seizing portions 31 are provided on either side of the ends of the planar walls 34, after the lamp pin contacting portions 41 are seized in the seizing portions 31, the pair of terminals 4 are both in an oblique state, and the terminals 4 can move with respect to the cables 5 due to the exist of the oblique state and the U-shaped notches 45, and thus the lower ends of the terminals 4 can approach each other. Meanwhile, the current circuit may be made in an on-state, since the pair of the first protrusions 44 may be provided on the inner side of the lower ends of the second fixing portions 40, the cables 5 have a tension of rebounding, and additionally the effect of the second protrusions 43 enables the two first protrusions 44 to contact one another without the need of external force when the lamp stem 2 is removed.

The lamp holder 3 may be provided with a first tightening portion 36 on bottom end to make the pair of the cables 5 go through the tightening portion 36 and to tighten the pair of the cables 5. The first tightening portion 36 has at least one arc-shaped step protruding inwardly along bottom face of the lamp holder 3. The lamp holder 3 may be further provided with a second tightening portion 6 on lower portion to tighten the pair of the cables 5. The second tightening portion 6 has a through hole 62, and the pair of cables 5 are connected with the lamp holder 3 by going through the through hole 62.

Specifically, the arc-shaped steps 33 also form a kidney-shaped hole, which can better tightening the cables 5 of cylindrical shape.

Preferably, the through hole 62 may be a kidney-shaped hole, which can also better tightening cables of cylindrical shape, the second tightening portion 6 may be an oval plastic piece. One of ordinary skill in the art would understood that, the through hole 62 may not be limited to a kidney-shaped hole, it may also be rectangular, circular or other shapes, the shape of the plastic piece can also be other shapes such as rectangular, circular, or the like.

One of ordinary skill in the art would understood that, while the exist of the first tightening portion 36 and the second tightening portion 6 fixes the cables 5 to prevent the cables 5 from swinging, the tightening effect of the tightening portions on the cables 5 may force the cables 5 to bend, and after the lamp stem 2 is removed, the pair of the first protrusions 44 may be easier to contact due to the bending effect of the cables 5.

Round chamfer 61 may be provided on the face of the end portion of the kidney-shaped hole 62 of the second tightening portion 6 to avoid, while the cables may be swinging, damage to the surface of the cables 5 due to the unsmooth end portion of the kidney-shaped hole 62.

The examples of the present disclosure are described above accompanying the drawings. However, the present disclosure is not limited to the aforesaid detailed embodiments. The above detailed embodiments are by ways of example only, but are not limitative. Under the motivation of the present disclosure, those skilled in the art can also take many forms, without departing from the purpose of the present disclosure and the scopes protected by the Claims, which are all within the protection of the present disclosure.

While various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the embodiment(s) set out in any claims that may issue from this disclosure. Specifically and by way of example, although the headings refer to a "Field of the Disclosure," the claims should not be limited by the language chosen under this heading to describe the so-called field. Further, a description of a technology in the "Background" is not to be construed as an admission that certain technology is prior art to any embodiment(s) in this disclosure. Neither is the "Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

The invention claimed is:

1. An illumination system comprising:

a plurality of lamps connected in series, wherein each of the lamps comprising:

a lamp luminary;

a lamp stem retaining the lamp luminary;

a lamp holder; and a pair of cables connected to the lamp holder, wherein each of the pair of cables comprises an end portion;

wherein the lamp stem comprises an insertion portion;

wherein the lamp holder comprises a base, extending inwardly and abutting the pair of cables, and opposing wall surfaces extending from the base, the base and opposing wall surfaces defining an accommodation space formed therein;

wherein each of the end portions of the pair of cables comprises an exterior side disposed proximate to a respective opposing wall surface and an interior side disposed away from the respective opposing wall surface and is provided respectively with a conductive terminal which is electrically connected with the cable and internally accommodated in the accommodation space;

wherein each of the conductive terminals comprises an upper portion comprising a lamp pin contacting portion and a lower conductive portion comprising a bottom end of the conductive terminal;

wherein the lamp pin contacting portions of the conductive terminals extend above the respective end portions of the pair of cables for contacting with a lamp pin of the lamp luminary and each are connected to an attachment area of the respective opposing wall surfaces and the lower conductive portions of the conductive terminals are disposed on the respective interior sides of the pair of cables and opposite each other within the accommodation space, whereby the lamp pin contacting portions and the lower conductive portions of the conductive terminals substantially form a V-shape;

wherein the opposing wall surfaces each have a bottom edge defined by an intersection of the respective opposing wall surfaces and the base; wherein the opposing wall surfaces, in a cross-sectional view of the lamp holder, is a substantially planar surface from each respective attachment area to each respective bottom edge;

wherein the lower conductive portions of the conductive terminals being are configured to contact one another or separate from each other;

wherein when the lamp stem is accommodated in the accommodation space, the insertion portion is clamped between the lower conductive portions to separate the lower conductive portions; and wherein when the lamp stem is removed from the accommodation space, the lower conductive portions elastically resume contacting one another.

2. The illumination system according to claim 1, wherein the accommodation space is provided with a tubular first accommodation space in an upper portion, and a second accommodation space in a lower portion;

wherein the second accommodation space is enclosed with two opposing planar walls extending upwardly from the bottom;

wherein the respective opposing wall surfaces are arc-shaped walls and are connected to the planar walls; and wherein the shape of the accommodation space is adapted to outer profile of the lamp stem.

3. The illumination system according to claim 2, wherein the accommodation space comprises an internal seizing portion to seize the lamp pin contacting portion.

4. The illumination system according to claim 3, wherein each of the upper portions of the conductive terminals comprises a first fixing portion; and wherein each of the cables comprises a protruding copper wire fixed on the respective first fixing portions to achieve electrical connection between the conductive terminals and the cables.

5. The illumination system according to claim 4, wherein each of the lower conductive portions comprises a tubular second fixing portion;

wherein each of the cables goes through and is disposed within the tubular second fixing portion;

wherein each of the tubular second fixing portion comprises a U-shaped notch, the U-shaped notch being defined in a body of the tubular second fixing portion, an opening of the U-shaped notch extending through the bottom ends of the tubular second fixing portion, which enables swinging of the cables along a radial direction of the tubular second fixing portion; and wherein the U-shaped notches face toward the arc-shaped walls.

6. The illumination system according to claim 5, wherein each of the conductive terminals further comprises an outer side;

wherein each outer side comprises a second protrusion; and wherein the second protrusion leans against one of the arc-shaped walls.

7. The illumination system according to claim 6, wherein the second protrusions comprises an elastic member with an arc-shaped surface.

8. The illumination system according to claim 1, wherein the base comprises a first tightening portion on a lower portion of the lamp holder to guide the pair of the cables through the first tightening portion and to tighten the pair of the cables; and wherein the first tightening portion comprises at least one arc-shaped step protruding inwardly along a bottom face of the lamp holder.

9. The illumination system according to claim 8, wherein the lamp holder further comprises a second tightening portion on the lower portion of the lamp holder to tighten the pair of the cables; and wherein the second tightening portion comprises a through hole, and the pair of cables is connected with the lamp holder by going through the through hole.

10. The illumination system according to claim 1, wherein the lower conductive portion is provided with a conductive first protrusion thereon and wherein the conductive first protrusions of the lower conductive portions of the conductive terminals is configured to contact one another or separate from each other.

11. The illumination system according to claim 10, wherein, when the lamp stem is accommodated in the accommodation space, the insertion portion is clamped between the conductive first protrusions to separate the conductive first protrusions, and, when the lamp stem is removed from the accommodation space, the conductive first protrusions elastically resume contacting one another.

* * * * *